US010039686B2

(12) United States Patent
Marshall

(10) Patent No.: US 10,039,686 B2
(45) Date of Patent: Aug. 7, 2018

(54) THERAPY DEVICE

(71) Applicant: Wesley Marshall, Hertfordshire (GB)

(72) Inventor: Wesley Marshall, Hertfordshire (GB)

( * ) Notice: Subject to any disclaimer, the term of this patent is extended or adjusted under 35 U.S.C. 154(b) by 377 days.

(21) Appl. No.: 14/388,102

(22) PCT Filed: Mar. 26, 2013

(86) PCT No.: PCT/GB2013/050782

§ 371 (c)(1),
(2) Date: Sep. 25, 2014

(87) PCT Pub. No.: WO2013/144607

PCT Pub. Date: Oct. 3, 2013

(65) Prior Publication Data

US 2015/0051529 A1 Feb. 19, 2015

(30) Foreign Application Priority Data

Mar. 26, 2012 (GB) ..... 1205226.2

(51) Int. Cl.
*A61H 1/02* (2006.01)

(52) U.S. Cl.
CPC ..... *A61H 1/0296* (2013.01); *A61H 1/0218* (2013.01); *A61H 2201/1284* (2013.01); *A61H 2203/0456* (2013.01)

(58) Field of Classification Search
CPC ..... A61H 1/02; A61H 1/0296; A61H 1/0218; A61H 2201/1284; A61H 2203/0456; A61H 2201/1607; A61H 1/0229; A61H 1/0292; A61F 5/04; A61F 13/12; A61F 5/012; A61F 5/05883; A61F 5/055; A42B 3/0473
USPC ..... 602/18, 32; 5/636–637
See application file for complete search history.

(56) References Cited

U.S. PATENT DOCUMENTS 4,034,747 A * 7/1977 Leroy ..... A61F 5/03 128/DIG. 23
4,118,813 A * 10/1978 Armstrong ..... A61F 5/56 5/636
4,854,306 A * 8/1989 Pujals, Jr. ..... A61F 5/055 128/DIG. 23
5,441,479 A * 8/1995 Chitwood ..... A61F 5/04 128/845
8,782,834 B2 * 7/2014 Berg ..... A47G 9/1027 5/639
2007/0088236 A1 4/2007 Tseng
2009/0211032 A1 * 8/2009 Lange ..... A47C 7/383 5/652

(Continued)

FOREIGN PATENT DOCUMENTS

CN 2586462 Y 11/2003
JP 2002085230 A 3/2002

OTHER PUBLICATIONS

International Search Report dated Jun. 26, 2013, for corresponding International Application No. PCT/GB2013/050782.

*Primary Examiner* — Ophelia A Hawthorne
(74) *Attorney, Agent, or Firm* — Gary Baker; BioPatent

(57) ABSTRACT

This invention provides neck traction devices wherein a resilient folded biasing body provides a traction force between a shoulder contacting side of the fold and paired head contacting regions. In use, a neck traction is developed when the folded device is applied to a patient with the respective shoulder and head regions contacting the patient's shoulder and head.

12 Claims, 6 Drawing Sheets

(56) References Cited

U.S. PATENT DOCUMENTS

| | | | | |
|---|---|---|---|---|
| 2010/0121243 | A1* | 5/2010 | Aune, Jr. | A61H 1/0296 602/32 |
| 2011/0178450 | A1 | 7/2011 | Mackowiak | |
| 2012/0330204 | A1* | 12/2012 | Baldauf | A61F 5/055 602/18 |
| 2013/0098364 | A1* | 4/2013 | Davis | A47G 9/1081 128/206.21 |

* cited by examiner

THERAPY DEVICE

FIELD OF THE INVENTION

This invention relates to a neck, or cervical spine, traction device.

BACKGROUND TO THE INVENTION

In an orthopaedic context, traction is a mechanism for relieving pressure on the spine. It has been shown that the ideal level of neck traction is related to the body-weight of a person.

Existing devices include pulley systems that attach to a door and comprise a sling in which a user positions their chin. The sling is connected using a rope and via a pulley to a bladder, which is filled with water or other liquid to provide a force to 'pull' the head in a direction away from the shoulders. Problems with this device may arise if the sling is positioned incorrectly or if the user fills the bladder with too much liquid. This may result in damage to the user's neck. In variations on this pulley device, the bladder may not be present and the user pulls on the rope to introduce the traction force. It is easy to use excessive force in such an embodiment.

Other methods include hanging one's head over the edge of a piece of furniture, and applying a weight to the chin and/or top of the head. Again, if the weight is too heavy, this may result in neck damage. Additionally, the head is unsupported, which may result in the force being applied unevenly or in a disadvantageous direction.

Inflatable devices are also known, which comprise a collar positioned around the user's neck. The collar is then inflated and expands in the longitudinal direction and provides a longitudinal traction force to the neck in the sagittal plane. Excessive pressure on the neck can be applied if the user continues to inflate the collar beyond the necessary amount. Additionally, the use of a hand pump can be awkward for some users.

Other devices include a two-piece ratcheting mechanism that can be used to apply an increased force as the ratcheting mechanism is operated.

SUMMARY OF THE INVENTION

Accordingly, the present invention is directed to a neck traction device comprising at least one head contact member and biasing means is a) connected to the at least one head contact member, wherein the biasing means comprises a resilient material that, when in use, provides a traction force on the user's neck via the at least one head contact member, and is b) contoured to accommodate at least part of a user's head region.

It is intended that "contoured" includes 'shaped so as to contact specifically'.

Deformation of the device from its natural rest state, when it is used, causes the ends to be forced away from one another due the natural resilience of the device, or biasing means attached to the device, thereby inducing a traction force on the user's cervical spine region when one of the ends is in contact with the user's head.

The resilience of the device may come from the body of the device itself and the material used to create the device, or it may come from attachments and/or inserts.

In accordance with the present invention, a traction force is exerted on the neck in the cervical section of the spine to relieve pressure on the user's neck and/or back. The use of a resilient material in the device allows for a simple and effective neck traction device that has increased longevity and a reduced risk of injury. The head can be supported to avoid injury and at the same time, the user's body weight can assist with generating the traction force, thereby reducing the risk of over exertion.

In one construction, the device has an integral structure and deformation of the device in order to position it on a user creates the traction force. In such an arrangement, the device, and therefore the integral resilient material, can be elastically deformed to provide a biasing force. By using an integral resilient material the device can be made wholly from that material, thereby reducing cost and making the device simple to manufacture and use. The use of an integral structure allows for the device to be substantially a one-piece device. This allows the device to be constructed, moulded or cut to a particular shape without the need to incorporate further parts. As an example, it may be in the form of a pillow or cushion shaped to be elastic deformed and provide the traction force. Layers of material may be combined to create an integral structure.

Advantageously, the neck traction device comprises at least two layers of material combined to create an integral structure and wherein those layers of material have different levels of resilience. This provides a device that has different properties according to which way it is used. For example, one of the layers may be stiff in compress and weak in expansion and so is strongly resistant to deformation when on the concave side, when in use, but provides little resistance when on the convex side, when in use. Therefore, combining it with a material of different properties allows one to vary the resistance according to which side the materials are positioned in use. One or more of the layers may also have a void, or cut-out, within its periphery.

Advantageously, the device comprises a material selected from a group comprising: foam material; sponge material; rubber; and plastics material. This list is not intended to be limiting and represents some examples of suitable materials. Many resilient materials are appropriate for use in the present invention, which have varying degrees of resilience and can be elastically deformed to varying levels. As an example, in the device comprising an integral resilient material, it may be constructed from a sponge material, which includes both natural and synthetic sponges, or from a polymer foam, including those made from polyether, polyvinyl and polyester. The elastic force provided by deformation of the material can be varied according to the material used, and the properties associated therewith, and the thickness of that material.

In another construction, the device further comprises a body portion and the biasing means are connected to the body portion. The device may have a body portion to which a resilient material may be attached or incorporated. This provides the device with a deformable body, to which a separate elastically deformable part maybe connected, can then be deformed to provide the force required for neck traction.

Preferably, the biasing means comprise a spring. A spring, in the form of a tension spring or a compression spring according to the position of the biasing means on the device, is a simple and effective means of providing a biasing force to the device. In such an embodiment, the body material may be a material having plastic properties wherein the at least one spring, when put under stress, provides a force to return the device to its original form.

In an alternative construction, the biasing means comprise at least one insert that can be inserted into a pocket on the body portion, and it is preferable that that the amount of bias adjustable by removal or addition of further biasing means. By providing a pocket into which an insert can be positioned allows for a single device to have varying resilience according to the insert provided. Plastics material or metal inserts of varying resilience can be provided that can be releasably attached to the device. There may be a plurality of pockets, or receiving sections, for adjusting the resilience of the device according to the level required. By adding or removing the inserts and/or springs to the device, it is possible to adjust the resilient force provided. This allows a single neck traction device to be used on people with varying body weight and muscle strength. Alternatively, the, or each, insert may be substantially unreleasably attached to the device, in which case the resilient force is predetermined. A combination of removable and permanent inserts is possible.

Advantageously, the device further comprises shoulder contacting members to contact a user's shoulders, when in use. By using the user's shoulders as an anchor point, the traction force can by more appropriately and accurately applied to the user's head and neck. Additionally, engaging the user's shoulders can provide extra stability. Additionally, where the shoulders are used as a contact point on the user, the device requires less material and therefore costs are reduced. This is because less material in the device reduces the force required to deform the device accordingly, thereby making it easier for the user to operate.

Preferably, an elongate member is provided that extends at least part of the way along the thoracic vertebrae, when in use. An elongate portion, especially on the base of the device, which extends underneath the user, when in use, can be used to provide extra stability by holding the device in place using a user's body weight. Additionally, the use of an elongate member, which may constitute a body support, can provide the user with a comfortable surface on which to position themselves and can aid with obtaining an effective posture.

It is particularly advantageous that once the device is in a deformed state, it can be locked in that state. This allows the device to be deformed, held in that deformed state, positioned correctly, and then released. Such a mechanism allows the user to readily operate and position the device without assistance from another person. The device may further comprise a ratchet mechanism or a slow release mechanism to gradually reduce the locking and holding force and so gradually increase the traction force induced. Such a ratchet mechanism may comprise an inflatable portion or a mechanical ratchet mechanism. Alternatively, it may comprise a spring locking mechanism and a cord or similar to allow the user to release the locking mechanism over a period of time rather than instantly. The locking system may comprise a protrusion formed by a protrusion on the device, for example a flange or extension formed from the foam body. This may be created using a manufacturing technique such as thermoforming or injection moulding. Additionally, or alternatively, it may be created from a 'living hinge' or a complex geometric design, constituting a fastening system. Where injection moulding is used, the device is easily made as a one-piece, or integral, structure wherein the shoulder and head contacting parts are formed at the same time as the body, or centre part, of the structure. The invention extends to a neck traction device resilient body for inserting into a filled support, the body being contoured so that when the resilient body is in place, the body and support operate as a neck traction device. Resilient inserts, or bodies, may be retrofitted to existing pillows, cushions and/or other filled supports in order to turn the support into a neck traction device. The resilient body may be in the form of an elongate strip of material and it may be shaped so as to be U-shaped or otherwise shaped to allow for the filled support to be elastically deformed in according with the inventions herein. As an example, the resilient body may be similar in shape to a shoe-horn. A pillow cover, or case, may be provided, either with 'built-in' resistance sections or with removable resistance sections. The pillow may be an orthopaedic pillow or it may be a pillow cover for use with an orthopaedic pillow.

The invention extends to a method of using a device according to the present invention.

Additionally, the invention extends to a method of making a neck traction device substantially as described herein.

BRIEF DESCRIPTION OF THE DRAWINGS

An embodiment of the invention will now be described, by way of example only, and with reference to the accompanying drawings, in which.

DETAILED DESCRIPTION OF EXEMPLARY EMBODIMENTS

Figure 1:
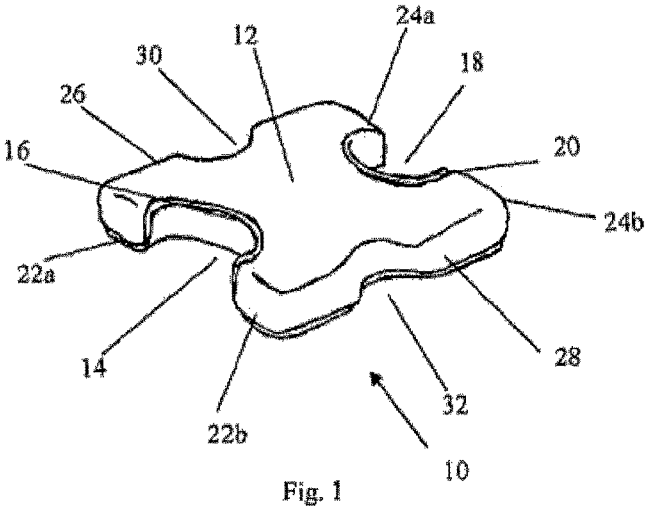
FIG. 1 is a diagram showing a neck traction device in accordance with a first embodiment of the present invention.
Figure 2:
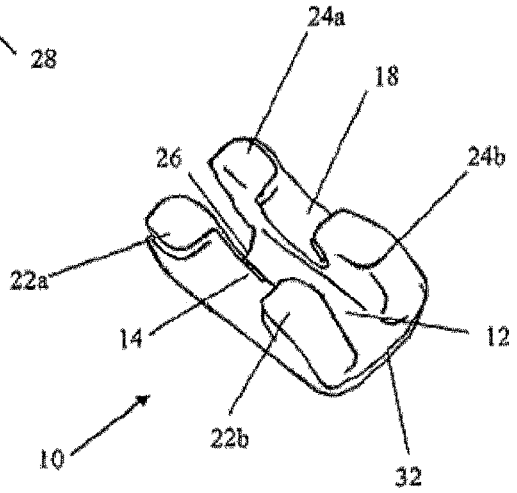
FIG. 2 is a diagram of the neck traction device of FIG. 1 in a deformed, in use, position.

FIGS. 1 and 2 show an integral neck traction device 10 having a generally square body 12, which comprises a resilient polymeric foam, for example polyurethane. The body 12 is provided with a first neck recess 14 along a first of its side 16 and a second neck recess 18 along a second side 20, the second side 20 being opposite the first side 16. The neck recesses 14 and 18 are substantially arcuate and are of a sufficient radius to receive a user's neck.

The first neck recess 14 is provided with shoulder contacting portions 22*a* and 22*b*, positioned along the first side 16 and on respective sides of the first recess 14. The second neck recess 18 is provided with head contacting portions 24*a* and 24*b*, each positioned along the second side 20 and on respective sides of the second recess 18.

The other two opposing sides 26 and 28 have smaller side recesses 30 and 32 positioned mid-way along their lengths.

In use, the user bends the device 10 so that the sides 16 and 20 are brought closer to one another in a manner that 'folds' the device 10 back upon itself. The side recesses 30 and 32 weaken the device 10 at a predetermined position such that the 'fold' line is between the two side recesses 30 and 32. Because the body 12 of the device 10 is constructed from a resilient material, the neck traction device 10 deforms elastically under the stress of 'folding'. Due to the nature of the resilient material, it attempts to return to its original shape while stress is provided. Therefore, the deformed device 10 provides a force, or biasing, separating the sides 16 and 20 in an attempt to return to its neutral position.

Whilst the device is in a deformed state, the user positions their neck into the first neck recess 14 and the second neck recess 18 whilst the device 10 is in the deformed position. The shoulder contacting portions 22*a* and 22*b* contact the user's shoulders and the head contacting portions 24*a* and 24*b* contact the lower part of the user's head in the region of the occipital and temporal bones. Because of the resilient force provided by the device 10, there is a traction force applied to the cervical and thoracic region of the user's spine.

Figure 3:
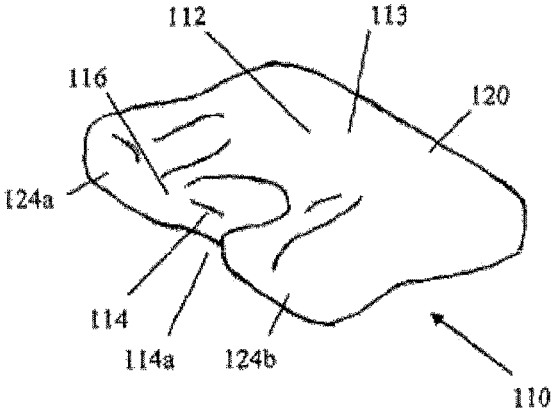
FIG. 3 is a diagram showing a neck traction device in accordance with a second embodiment of the present invention.
Figure 4:
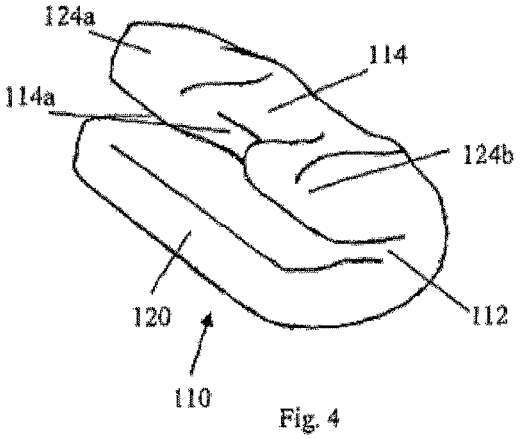
FIG. 4 is a diagram of the neck traction device of FIG. 3 in a deformed, in use, position.

FIGS. 3 and 4 show a neck traction device 110 in the form of a resilient integral body 112 having a substantially rectangular shape. In the top surface 113 of the body 112 and in close proximity to one long side 116 of the body 112, a recess 114 is provided. The recess 114 is shaped so as to engage the lower part of a user's skull, when in use, and a neck recess 114*a* is provided along the long side 116. Each side of the recess 114 are respective head contacting members 124*a* and 124*b*. The opposite long side 120 is not provided with a recess. In use, the user folds the opposite long edge 120 underneath the body 112 such that the long edge 120 is positioned in close proximity to the long side 116 and below thereof, thereby leaving the recess 114 on the uppermost surface. The user positions their head into the recess 114 with their neck in the neck recess 114*a*. The head contacting members 124 engage that base of the user's head. The resilient body 112 provides a corrective force, which in turn provides a force to separate the sides 116 and 120. When the device 110 is in use, the elastic force provided by the resilience in the body 112 thus provides a neck traction force to the user.

Additionally, the long side 120 may be provided with a lip, or protrusion (not shown) which can be used to put the user's neck into flexion, when in use.

Figure 5:
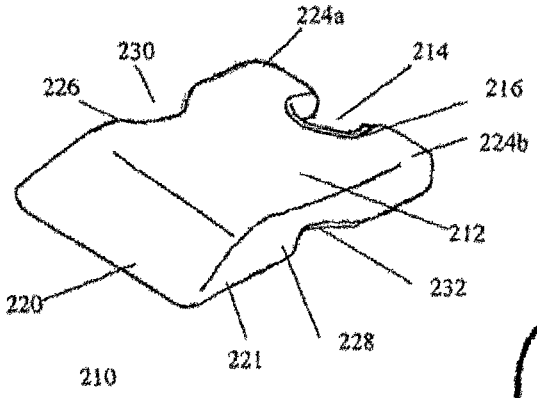
FIG. 5 is a diagram showing a neck traction device in accordance with a third embodiment of the present invention.

FIG. 5 shows a neck traction device 210 of a similar nature to that shown in FIGS. 1 and 2, having a body portion 212 and a neck recess 214 in a first side 216. The neck recess is provided with head contacting portions 224*a* and 224*b* on respective sides of the recess 214. The opposite side 220 is in the form of a wedge portion 221 extending away from the first side 216 and tapering in the same direction. The other pair of opposing sides 226 and 228 are provided with side recesses 230 and 232.

In use, the device 210 is folded upon itself along a line between side recesses 230 and 232, and the neck recess 214 is positioned around the user's neck with the head contacting portions 224*a* and 224*b* positioned against the lower part of the user's head. The wedge portion 221 is positioned so that it extends under the user's back and at least part way down the user's back, for example, the thinnest end of the wedge 221 reaching the Th5 vertebra of the spine. The user's body weight on the wedge portion 221 holds the side 220 in place and the resilience in the folded body 210 provides a traction force on the user's neck and spine.

Figure 6:
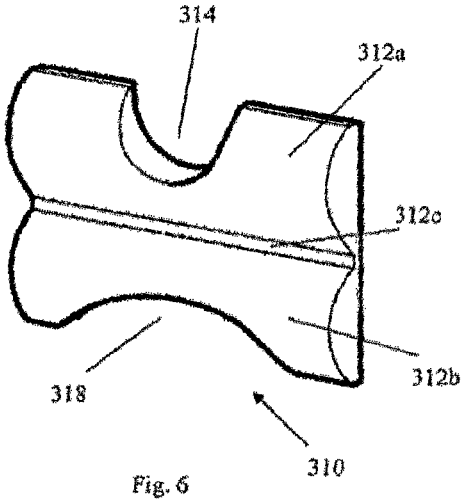
FIG. 6 is a diagram showing a neck traction device in accordance with a fourth embodiment of the present invention.
Figure 7:
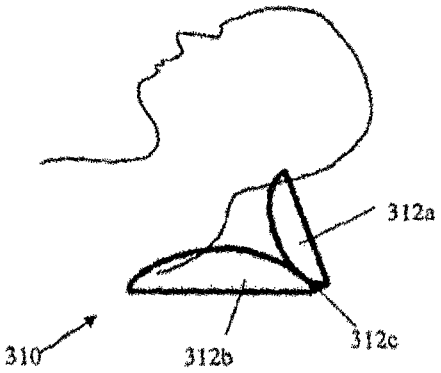
FIG. 7 is a diagram of the neck traction device of FIG. 6 in a deformed, in use, position.

FIGS. 6 and 7 show a neck traction device 310 comprising a body of 312 two resilient semi-cylindrical parts 312*a* and 312*b* connected along respective sides by a hinge 312*c*. The first part of the body 312*a* is provided with a neck recess 314 in the side opposite the hinge 312*c*. The second part of the body 312*b* is provided with an upper back recess 318 in the side opposite the hinge 312*c*.

When in use, the body portion 312*b* is positioned on a flat surface and the user positions their lower neck and their upper back, including the lower cervical and upper thoracic vertebrae within the upper back recess 318. The other body portion 312*a* is pivoted about the hinge 312*c* and placed on top of the first body portion 312*b*. The user's upper neck and head is then positioned within the neck recess 314.

The weight of the user's head on the first body part 312*a* pushes that part against the second body part 312*b*. As these parts 312*a* and 312*b* are formed from resilient material, they 'push back' on the user's head and thus provide a traction force.

The device 310 may be constructed such that it will be necessary to provide some force to 'push' the second body portion 312*a* into the first body portion 312*b* before positioning the user's head therein. The user's head thus acts as a locking pin and keeps the two body portions 312*a* and 312*b* under stress and, therefore retains the resilient elastic force, and thus the traction force, between the two parts.

When not in use the flat faces of the two semi-cylindrical parts 212*a* and 212*b* can be positioned adjacent one another to store the device in a more compact manner. This also reduces the risk of the device 310 being damaged whilst not in use.

The device 310 may be provided with a locking mechanism to retain the two semi-cylindrical parts 312*a* and 312*b* together when not in use, which may be in the form of a catch, magnets retained within the two parts, a hook-and-loop fastener, a popper, or other fastening means.

Figure 8:
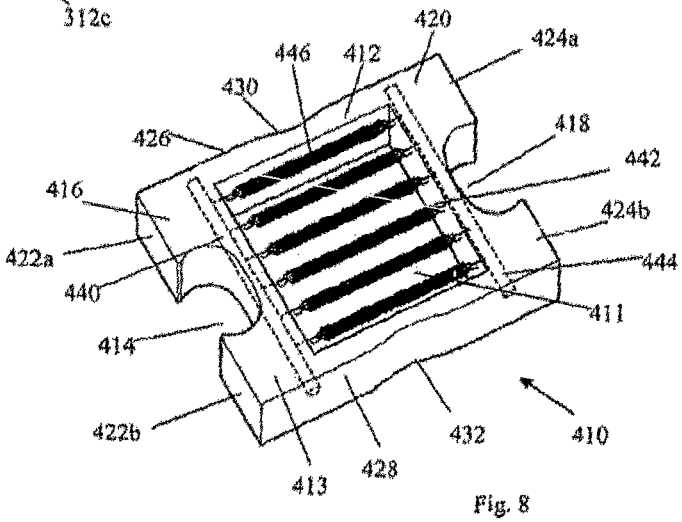
FIG. 8 is a diagram showing a neck traction device in accordance with a fifth embodiment of the present invention.

FIG. 8 shows a device 410, having a substantially square-shaped body 412 comprising a resilient material. The inside of the body 412 is hollow such that the body is substantially a frame with a void 411 therein. As with the device 10 in FIG. 1, the device 410 comprises a first neck recess 414 with shoulder contacting portions 422*a* and 422*b* positioned along the first side 416 and on respective sides of the first recess 414. A second neck recess 418 is provided with head contacting portions 424*a* and 424*b*, each positioned along the second side 420 and on respective sides of the second recess 418.

The other two opposing sides 426 and 428 have smaller side recesses 430 and 432 positioned mid-way along their lengths.

Anchor rods 440 and 442 are positioned within the material of the body 412 adjacent the two opposing sides 416 and 420 respectively. Hooks 444 are connected to the anchor rods 440 and 442 in such a manner that each hook 444 connected to one anchor rod 440 and 442 has a corresponding hook 444 substantially opposite it. Springs 446 are connected at each end to the hooks 444 so that they reach across the void 411 between the sides 416 and 420. The rods 440 and 442 are both positioned in close proximity to the upper surface 413 and the springs 446 are compression springs.

The neck traction device 410 is intended to be use in the same way as the device 10 shown in FIGS. 1 and 2, with the user's neck fitting into the recesses 414 and 418 as it would into recesses 14 and 18 in those Figures. When the device 410 is in use, the compression springs 446 are internal to the body, i.e. on the inside of the 'fold' and so provide a resistive force to the device.

The device may be provided with weakened portions, or cuts, along the sides 426 and 428 such that the side profile resembles a bow-tie. In such a construction, the body 412 may be manufactured from a solid material rather than foam material, which is able to deform at the weakened portions.

The rods 440 and 442 may, alternatively, be positioned in close proximity to the lower surface of the body 412. In such an embodiment, tension springs 446 are used because the springs will be positioned on the outside of the 'fold', and so will be in tension.

Figure 9:
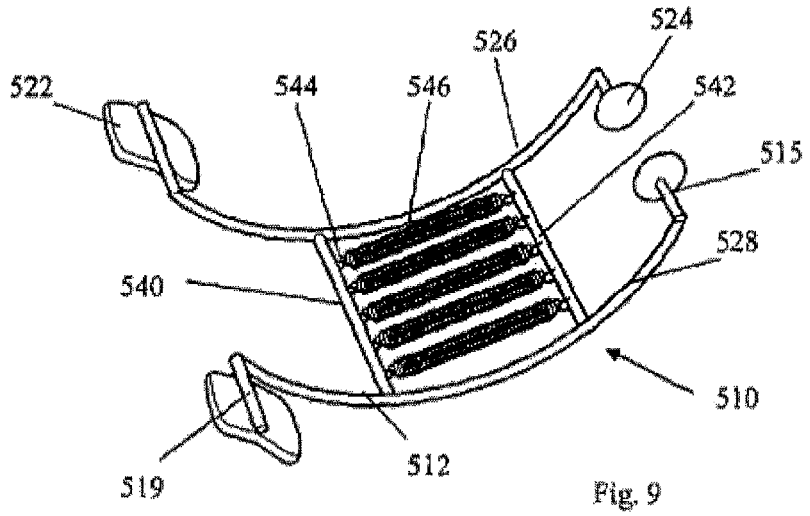
FIG. 9 is a diagram showing a neck traction device in accordance with a sixth embodiment of the present invention.

FIG. 9 shows a neck traction device 510 comprising a framework 512 having resilient arcuate side members 526 and 528, each having an inwardly directed extension 515 at one end and an outwardly directed extension 519 at the other end. The inwardly directed extension 515 has a head contacting pad 524 pivotally connected thereto. The outwardly directed extension 519 has a shoulder contacting pad 522 pivotably connected thereto. The two sides 526 and 528 are connected by anchor bars 540 and 542 along their length such that the head contacting pads of the sides 526 and 528 are aligned to face one another. The anchor bars 540 and 542 are positioned such that they are spaced apart along the arc of the sides 526 and 528. The anchor bars 540 and 542 are each provided with anchor points 544 positioned such that each anchor bar 540 and 542 has one of a pair of points 544 and each pair are aligned opposite one another. Tension springs 546 are attached by one to a first anchor point 544 of a pair and the other end of the tension spring 546 is attached to the second anchor point 544 of the pair. The springs 546 are internal to the arc formed by the side members 526 and 528.

In use, a user positions each of the shoulder contacting pads 522 on a respective shoulder, and the head contacting pads 524 are positioned on the base of the skull at the top of the neck. In positioning the device 510, strain is put onto the springs 546 and the resilient side members. Because of the natural bias and the elastic nature of the side members 526 and 528, the device 510 has a tendency to return to its original shape and so the device 510 provides a resilient force putting the user's neck into traction.

The shoulder contacting parts may be adjustable along the framework and along the extensions in order to adapt the device to fit to people of varying size. It may also be possible to adjust the width of the device by having length adjustable anchor bars 540 and 542.

Figure 10:
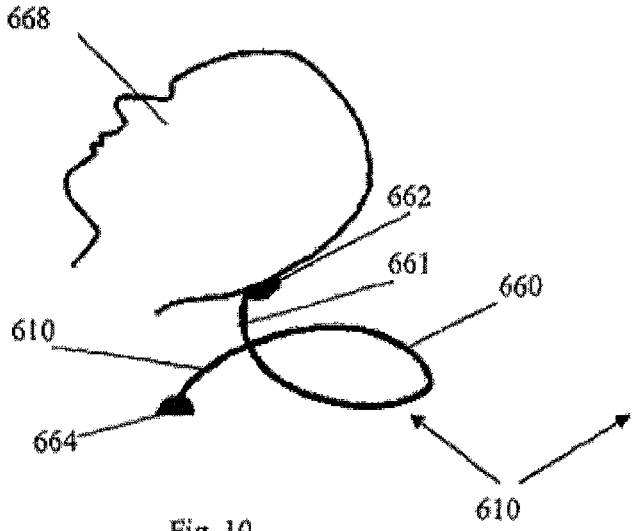
FIG. 10 is a diagram showing part of a neck traction device in accordance with a seventh embodiment of the present invention.
Figure 11:
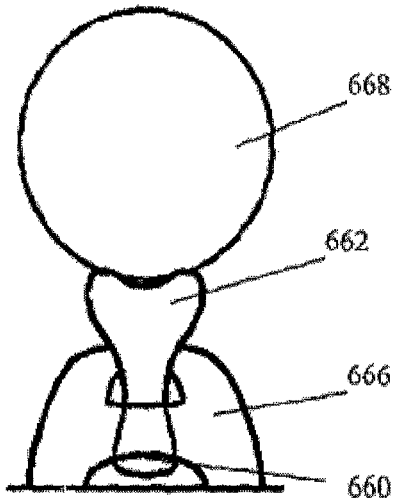
FIG. 11 is a diagram showing an end view of the neck traction device of FIG. 10.

FIGS. 10 and 11 show a neck traction device 610 comprising a resilient member 660 in the shape of a lowercase Greek letter Alpha, that is, α. The top arm 661 of the resilient member is provided with a head contacting member 662 and the lower arm 663 is provided with a surface contacting member 664. The resilient member 660 is retained within a casing 666 to provide support to the device 610.

In use, the user 668 lays on a surface and positions their head on the head contacting member 662. The force provided by the weight of the user's head 668 on the head contacting member 664 induces an elastic deformation in the resilient member 660, which causes a traction force to be provided to the user's head 668. The user may choose to push down on the head contacting member 662 with their head, thereby increasing the traction force experienced on the user's head 668.

The resilient member 660 may be constructed from metal or plastics material, or a combination thereof.

Figure 12:
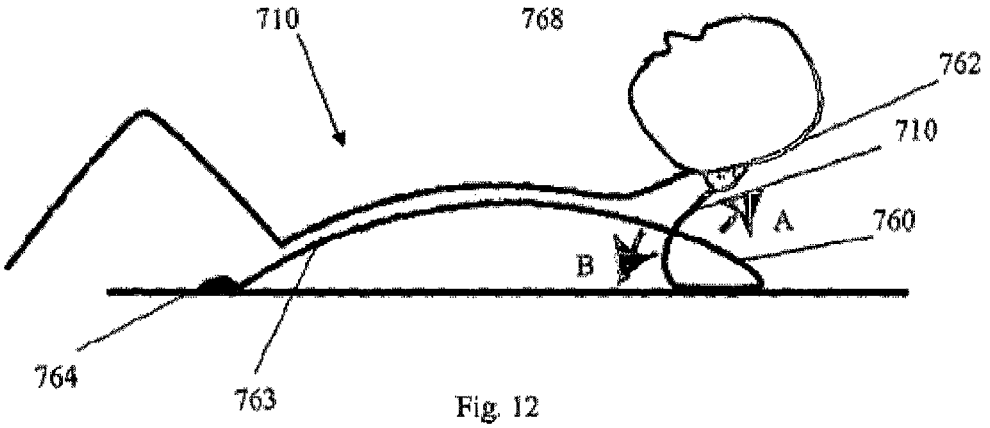
FIG. 12 is a diagram showing a neck traction device in accordance with an eighth embodiment of the present invention.

FIG. 12 shows a neck traction device 710 similar to that shown in FIGS. 10 and 11 but wherein the lower arm 763 (663 in FIG. 10) is arcuate and elongated such that it passes 28 underneath the user's back, when in use. The device 710 is provided with an α-shaped resilient member 760 having a head contacting member 762 on its upper arm 761 and an elongate lower arm 763, the end of which is provided with a surface contacting member 764.

Arrow B on FIG. 12 shows the force on the resilient member cause by the body weight of the user 768. The resultant force in the head contacting member 762 is indicated by arrow A. This shows how the neck traction force A is provided by the body weight of the user 768. As a result of the lower arm 763, which constitutes an elongate body portion, the device 710 is provided with a stable base. Additionally, the force provided by the user's body weight on the lower arm 763 is proportional to the user's body weight and provides an increased traction force provided through the head contacting member 762 compared to other devices.

Figure 13:
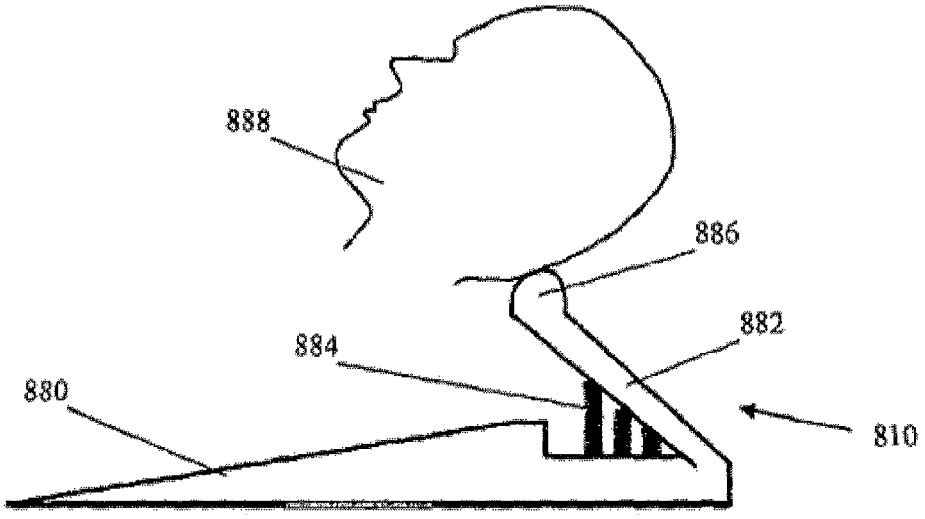
FIG. 13 is a diagram showing a neck traction device in accordance with a ninth embodiment of the present invention.

FIG. 13 shows a neck traction device 810 comprising a base portion 880, pivotally connected to an arm 882. The arm 882 is biased using compression springs 884 in a position raised from the base portion 880 with compression springs 884 arranged between the underside of the arm 882 and the upper surface of the base portion 880. A head contacting member 886 is provided at the end of the arm 882 furthest from the pivot between the arm 882 and the base portion 880. The base portion 880 is wedge-shaped with the thickness decreasing in the direction away from the pivot with the arm 882.

In use, a user 888 lays on the wedge of the base portion 880, which extends at least part way along the user's thoracic vertebrae. The weight of the user 888 holds the device 810 in place while in use. The user 888 compresses the arm 882 against the compression springs 884 and positions the head contacting member 886 against the base of their head, close to their neck. The resilient and elastic nature of the springs 884 induces a traction force on the user's head.

Figure 14:
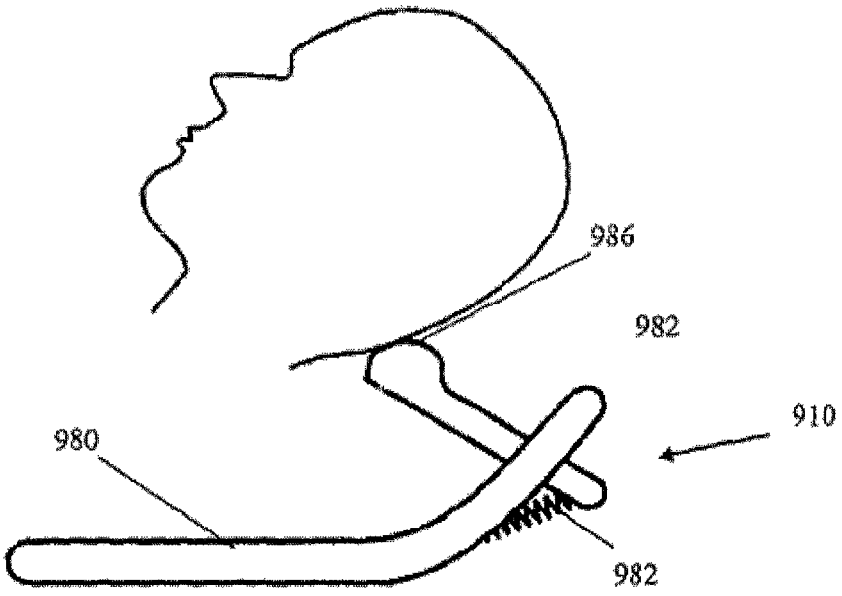
FIG. 14 is a diagram showing a neck traction device in accordance with a tenth embodiment of the present invention.

FIG. 14 shows a neck traction device 910 comprising a substantially elongate base portion 980. The base portion 980 is curved substantially upwards at one end and an arm 982 pivotally attached to the base portion 980 at a position along its length on the curved section of the base portion 980. One end of the arm 982 is connected to one end of biasing means in the form of a tension spring 984. The other end of the spring 984 is connected to the base portion 980. The arm 982 is provided with a head contacting member 986 at the opposite end to that to which the biasing means are attached. The base portion is provided with a range-of-motion limiter (not shown) that limits rotation of the arm 982 beyond a certain position. Due to the nature of the tension spring 984, the natural position of the arm 982 is against the limiter with the head contacting member 986 raised relative to the device 910.

The device 910 works in the same manner as the device 810 shown in FIG. 13. The tension springs provide a traction force, when in use, by biasing the arm 982 such that it pushes against the user's head.

Figure 15:
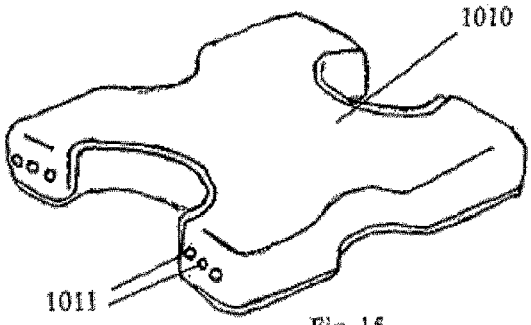
FIG. 15 is a diagram showing a neck traction device in accordance with an eleventh embodiment of the present invention.
Figure 15A:
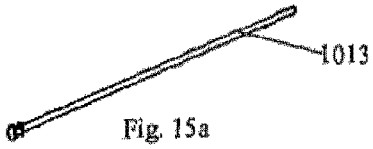
FIG. 15*a* is a diagram showing a neck traction device insert for use with the embodiment shown in FIG. 15.

FIG. 15 shows a device 1010 having a structure similar to that of the device 10 of FIG. 1. The device 1010 has been adapted to differ from the device 10 of FIG. 1 in that it comprises recesses 1011 for accepting a stiffening rod 1013 as shown in FIG. 15*a*. The recesses 1011 are substantially perpendicular to the side in which they are located and they run parallel with one another within the device 1011. The rod 1011 can be inserted into the device in order to increase the resistance provided by the device 1010. The recesses 1011 and the rod 1013 may be provided with screw threat attachments so that the rod 1013 can be securely held within the recess 1011. Alternatively, the rods 1013 may be held in place using a different attachment mechanism.

Figure 16:
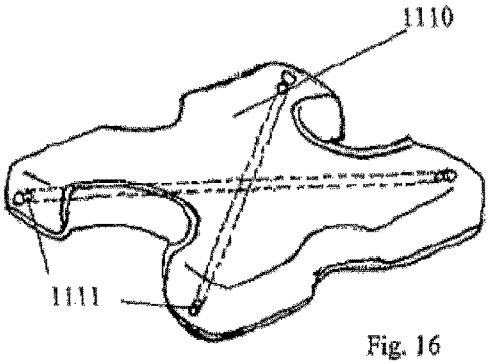
FIG. 16 is a diagram showing a neck traction device in accordance with a twelfth embodiment of the present invention.

FIG. 16 shows a device 1110 having a structure similar to that of the device 1010 shown in FIG. 15. The recesses 1111 on device 1110 are positioned to be on an angle between opposing corners of the device 1110. The recesses 1111 are adapted to accept stiffening rods as shown in FIG. 15*a* and may be provided with retaining means for keeping the rods 1013 within the recesses.

Figure 17:
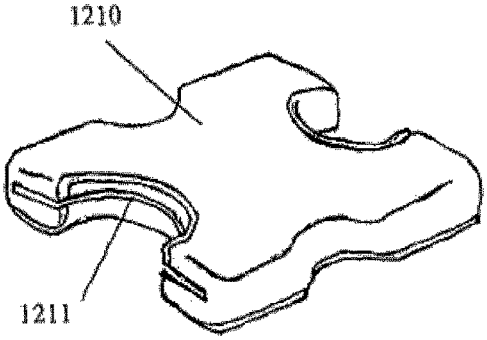
FIG. 17 is a diagram showing a neck traction device in accordance with a thirteenth embodiment of the present invention.
Figure 17A:
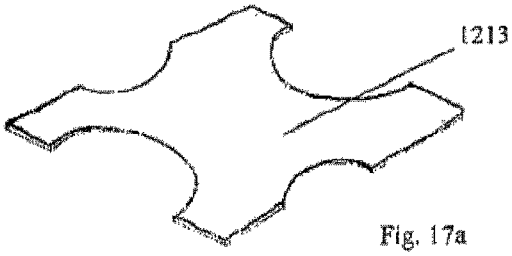
FIG. 17*a* is a diagram showing a neck traction device insert for use with the embodiment shown in FIG. 17.

FIG. 17 shows a device 1210 having a structure similar to that of the device 10 of FIG. 1. The device 1210 has been adapted to differ from the device 10 of FIG. 1 in that it comprises slot 1211 for accepting a stiffening board 1213 as shown in FIG. 17*a*. The board 1213 can be inserted into the slot 1211 and retained therein to increase the resistance to deformation of the device 1210. The board 1213 may be retained by way of straps or a hook-and-eye flat that closes over the slot.

Figure 18:
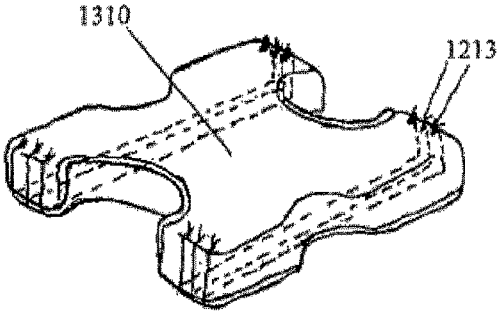
FIG. 18 is a diagram showing a neck traction device in accordance with a fourteenth embodiment of the present invention.

FIG. 18 shows a device 1310 having a structure similar to that of the device 10 of FIG. 1. The device 1310 has been adapted to allow for elastic straps 1313 to be attached by their ends to the shoulder contacting portions 1322 and the head contacting portions 1324. The straps 1313 pass on the intended convex side of the device 1310, when in use, so that they are stretched and their elasticity provides an increase in the resistive force over the device 10 of FIG. 1. The straps 1313 may be detached from the device 1310 when not in use. Alternatively, although less desirable, the straps may be compression springs located on the concave side of the device 1310, when in use.

Figure 19:
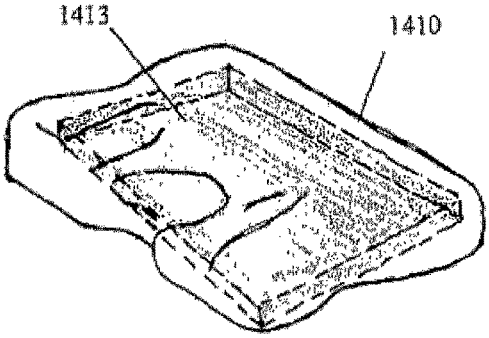
FIG. 19 is a diagram showing a neck traction device in accordance with a fifteenth embodiment of the present invention.

FIG. 19 shows a device 1410 similar to the device 110 shown in FIG. 3. The device 1410 comprises a central core 1413 of stiffer material than the rest of the device 1410 to provide increased resistance to deformation.

Figure 20:
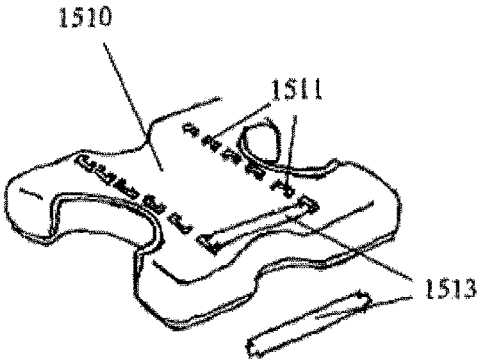
FIG. 20 is a diagram showing a neck traction device in accordance with a sixteenth embodiment of the present invention.

FIG. 20 shows a device 1510 having a structure similar to that of the device 10 of FIG. 1. The device 1510 is further provided with pairs of holding brackets 1511, which are adapted to receive respective ends of a stiffening strip 1513. The holding brackets 1511 are positioned on the concave side of the device 1513, when in use. The attachment of stiffening strips 1513 increases the resistance to deformation of the device 1510. Additionally, as the brackets 1511 are spread across the width of the device 1510, the stiffness on each side may be varied according to where the strips are attached. This is particularly advantageous where the user has an imbalance in their strength and requires a variable traction force. The provided strips 1513 may have varying stiffness so that the resistance of the device 1510 can be adjusted according to the purpose. The location and orientation of the brackets 1511 may be varied according to the desired use of the device 1510. Additionally, they may be adjustable so that the user can change their orientation.

Figure 21:
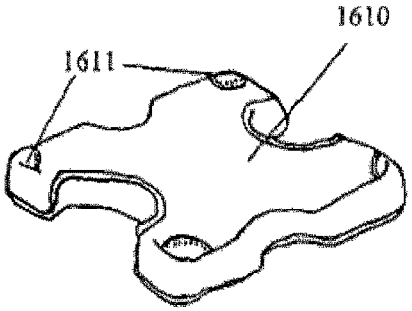
FIG. 21 is a diagram showing a neck traction device in accordance with a seventeenth embodiment of the present invention.

FIG. 21 shows a device 1610 having a structure similar to that of the device 1510 of FIG. 20. However, the brackets 1511 are replaced with pockets 1611 that are positioned on each corner and are orientated so that each pocket 1611 of each pair faces the other pocket of the pair on opposing corners. The ends of the stiffening strips (not shown) tuck as into the pockets and are retained therein whilst the strip extends diagonally across the device 1610 on the concave side of the device 1610, when in use.

Figure 22:
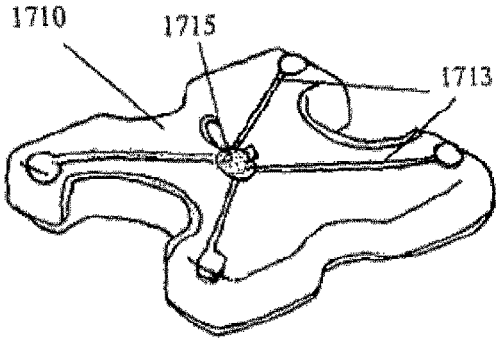
FIG. 22 is a diagram showing a neck traction device in accordance with an eighteenth embodiment of the present invention.

FIG. 22 shows a device 1710 having a structure similar to that of the device 10 of FIG. 1. The device 1710 is provided with straps 1713 extending from each corner of the device 1710 to a central spring stop 1715. The strings 1713 are positioned along the convex side of the device 1710, when in use, and are therefore are extended upon deformation and so provide resistance to deformation. The strings 1713 can be threaded through the spring stop 1715 to shorten their effective length and so increase the resistance. Other stopping mechanisms may be used. The strings 1713 may be threaded through the device 1710 and secured on the intended concave side of the device 1710 so as to make the connection more resistant to being damaged by the forces involve when the device 1710 is in use.

Figure 23:
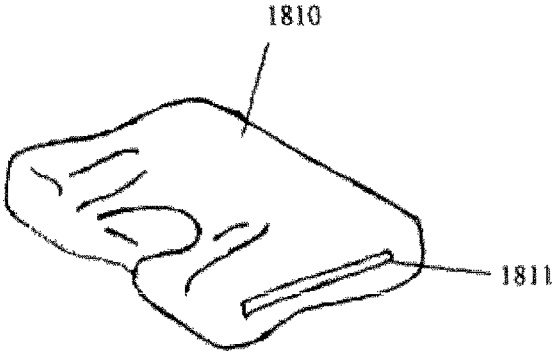
FIG. 23 is a diagram showing a neck traction device in accordance with a nineteenth embodiment of the present invention.
Figure 23B:
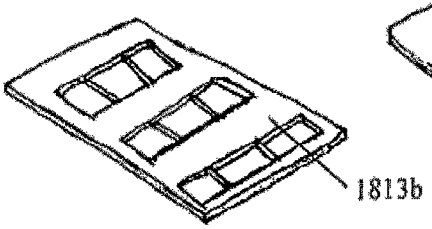
FIG. 23*b* is a diagram showing a neck traction device insert for use with the embodiment shown in FIG. 23.
Figure 23A:
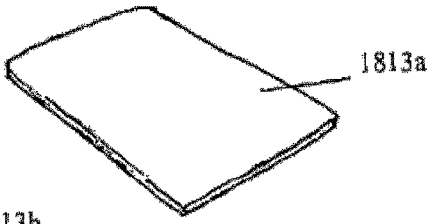
FIG. 23*a* is a diagram showing a neck traction device insert for use with the embodiment shown in FIG. 23.

FIGS. 23 to 23*b* show a device 1810 similar to that shown in FIG. 3. The device 1810 is adapted to comprise a receiving slot 1811 in its periphery, which is able to accept and retain a stiffening board 1813. The board 1813 is inserted into the device 1810 and increases the resistance to deformation of the device 1810. As shown in FIG. 23*a*, the stiffening board 1813*a* may comprise a flat section or it may be shaped according to the desired resistance. Alternatively, the stiffening board 1813*b*, as shown in FIG. 23*b*, may comprise one or more voids within its periphery so as to adjust the stiffness of the board 1813*b*.

It will be appreciated that integral neck traction devices, such as those shown in FIGS. 1 to 5, may be in the form of cushions or pillows, wherein the stuffing provides a resistive force when the device is folded upon itself. Furthermore, it will be appreciated that such integral devices may be provided with a cover in order to increase the comfort to the user.

The embodiments of the present invention shown in FIGS. 1 to 5 may be adapted such that they comprise two or more layers of foam, which may be connected together and/or contained within a covering. In such an embodiment, the layers may be chosen according to their characteristics, for example, one layer may be chosen for its resilience and the other layer chosen for its softness in order to provide comfort for the user when using the neck traction device. Multiple layers of the same, or different, material may be used to increase or decrease the resilience of the device by having properties in each layer that vary the compression strength through the device. The layers may be joined using known fastening methods, including hook-and-loop fasteners, clips, clamps, poppers, buttons, zippers and ties. The layers may be encapsulated in a third material, which provides a cover or outer coating to the device.

The device may comprise resilient materials including metal, composites, natural and synthetic materials and/or plastics materials that are capable of elastic deformation. Optionally, once the device is in the deformed state, it may be locked in that position and subsequently released. This allows the user to position the device in place while the device is locked and then unlocking the device to apply the required traction force to the user's neck. This may be particularly advantageous for the embodiments shown in the Figures. The locking mechanism my be in the form of a hook-and-loop fastener, which allows easy fixing and releasing of the locking mechanism, or alternatively, it may comprise other type of fastening devices, for example, poppers, a toggle, a button, a zipper, or a loop of material that extends around the device and can then be removed. Other fastening mechanisms may also be appropriate and applicable.

It will be appreciated that the head contacting members and the shoulder contacting members may be constructed from a substance such as 'memory foam', low-resilience polyurethane or "LRPu", thereby reducing the degree of contouring required as the device will shape as required during use. Other parts of the device that may need to be contoured to the user may comprise LRPu. Likewise, other materials with similar or identical properties that allow the device to fit the user more comfortably may be used.

The invention extends to a filled support, for example a cushion or a pillow, comprising memory foam. The memory foam may be a coating or a cover, and it may be integral to the support or a separate cover therefor. When in use, the memory foam adapts and is contoured to accommodate at least part of a user's head region. The memory foam can adapt and contour to a user's head and/or shoulders while in use, thereby making it more comfortable. As an example, the neck traction device may be in the form of a pillow, which may comprise memory foam, into which resilient inserts may be placed to provide a traction force. Once the user has finished using the device for neck traction, the resilient inserts may be removed or adjusted to allow the user to use the pillow in a regular manner. Non-memory foam pillows or cushions into which removable resilient bodies, or strips, may be placed may also be used. The invention further extends to resilient inserts for retrofitting into filled supports in order to allow them to be used as described herein.

Recesses on opposing sides of the device may be provided so that the device can be used in two different orientations, such that in using one pair of opposing sides a first resistive force is induced on the user and when using the other pair of opposing sides a second resistive force is induced. Each pair of sides permits engaging of the user's head and exerts a different level of force from the other pair. Alternatively, or additionally, the recesses may allow for different sized users to use the same device. For example, the a recesses on one pair of opposing sides may be suited to a 'large' neck and head and the recesses on the other pair of opposing sides may be suited to a 'medium' neck and head. Where the profile of the device is a shape other than a square, for example a hexagon or octagon, more sizes may be applied to a single device. With the use of different foam materials being used in combination, the device may provide different forces depending upon the direction it is deformed and so a single device may be used by those of different sizes and those requiring different forces. With the use of a symmetrical or asymmetrical shape, or shaped core within the device, the resistance may be further varied, in combination with the size being varied according to the opposing sides. This creates a device with various different traction forces that can be used by more than one size user.

Contouring of the device may be obtained through use of the device, for example, by the use of memory foam or an applicable alternative material that enables the device to become congruent with the user's head and/or neck region, at least temporarily.

It may be desirable for the device to be fitted with a head and/or a shoulder engaging section. This may be in the form of a strap that can be connected around a user's head or under the user's arms engaging their arm-pits, for example using a hook and eye connection (Velcro®), or other releasable connection. Alternatively, or additionally, the engaging section may comprise elastic material or plastics material.

The device may comprise a periphery with a void within its circumference, similar to that shown in FIG. 8. Such a design provides a device that provides less resistance than a 'filled' device due to some of the biasing material having been removed. The device may then be provided with inserts to increase the resistance as required with the inserts being in the form of foam pieces or compression springs that fit on the concave side, when in use, to provide resistance to compression. Alternatively, the device may comprise an insert to resist expansion positioned nearer the opposite, or convex, side, when in use.

The device may be provided with a shaped core, either regular or irregular, such that deformation in one direction is less stiff than deformation in another direction. By adjusting the shape of the core, the resistance can be varied according the orientation of the device, when in use.

The device may comprise slots or recesses along opposing sides to accept a resistance strip or section.

It may be desirable to join two devices such that a user can receive 360° traction rather than just at the back of the head. In such a situation the devices may be joined using known connection means with one device positioned under a user's jaw and the other at the back of their head, or on each side of their head and engaging the jaw and back of their head.

The device may comprise a massage device in the form of a vibrating attachment that is attached to, or inserted into, the device.

A variable force device may be attached to the neck traction device to increase and/or decrease the traction for a period. Such a device may work on a piston and cylinder arrangement with the force adjusted by pulling the ends of the device together or pushing them apart when the device is in position.

The device may comprise inflatable sections. For example, the device shown in FIG. 1, 3 or 6 may comprise inflatable sections to make transporting the device easier. Alternatively, the device may comprise both foam sections and inflatable sections in combination, wherein the inflatable sections can be used to adjust the resistance of the device to deformation.

The device may be partially deformed, for example partially C-shaped, so that further deformation of the device creates a resistive force. The resistance is strongest along the convex side of the deformed device and so the ends are forced away from one another to provide a traction force.

The device may comprise metal, foam, graphite, silicone, plastics material, polycarbonate and/or composite materials.

The neck traction may comprise a first recess along one side, which may be adapted to accept a user's neck, and a second recess along an opposite side, which may be adapted to accept a user's head region. The device may comprise further recesses along its other edges to provide weakened regions so that the position of any bend or fold is predetermined.

The device may be manufactured using injection moulding of foam. Such a process may incorporate the use of undercutting and may result in a self-skinning, closed cell product. By using such a processing, possible with the feature of injecting two materials at once, a foam device can be produced in a single process.

It may be desirable to incorporate dimples, protrusions and/or patterns on the device in order to direct pressure at a desired position or to create a certain force, for example in a particular direction or at a specific location. This may be created by thermoforming or injection moulding.

A weakened region may be positioned across the device from one side to the other to create a hinge-type region at which that device will fold or bend. This creates a known position around which the device will deform.

A coating process may be used to at least partially encapsulate the device in order to seal it, although preferably, the whole device is coated, covered or encapsulated. This may include the use of thermoforming of the device or other coating processes.

The invention extends to a device for inducing neck traction on a user and a part, accessory or attachment that can be connected or attached to the device in adjust the resilience of the device, and therefore the force of the traction experienced by the user. The part, accessory or attachment may be an insert and it may comprise plastics material and/or metal, possibly in the form of a tension or compression spring.

The device may incorporate a tensioning system either as a substitute for the spring locking mechanism of FIG. 22, or as part of a locking mechanism. The tensioning system may comprise a rotational tensioning device such that rotation of a disc in one direction causes straps, or laces, to be tightened and brought towards the tensioning a device. Rotation of the disc in the opposite direction causes the straps to be released, or slackened, and the tension in the device decreased. In using such a rotational tensioning device, the tensioning adjustment is simple and compact.

It will be appreciated that a combination of features from different embodiments may be employed in a single device.

The invention claimed is:

1. A neck traction device comprising a resilient body having a pair of upper arms and a pair of lower arms, wherein:

the upper arms of the body are separated by a first neck recess; and, the lower arms of the body define shoulder contact members on each side of a second neck recess;

wherein, the device is configured so that when folded at a position along the body to bring the respective pairs of arms towards one another, a resilient biasing between the neck recesses provides a force for neck traction.

2. The neck traction device of claim 1, wherein:

the resilient body is a resilient X-shaped body or H-shaped body, wherein:

upper arms of the X-shaped body or H-shaped body are separated by the first neck recess; and, lower arms of the X-shaped body or H-shaped body define shoulder contact members on each side of a second neck recess.

3. The neck traction device of claim 2, the resilient body is the resilient X-shaped body.

4. The neck traction device of claim 1, wherein the position along which the body is folded comprises a fold line of resilient material between the neck recesses.

5. The neck traction device of claim 4, wherein the fold line is adapted to function as a biasing means that resiliently deforms to bend or fold the pairs of opposing upper and lower arms towards one another providing the traction force.

6. The neck traction device of claim 1, wherein the folded position, upper arms, and lower arms together comprise an integral structure.

7. The neck traction device of claim 1, wherein the resilient biasing between the neck recesses is provided by an elastic deformation in the body adapted to provide the traction force.

8. The neck traction device of claim 1, further comprising a biasing element connected to the body between upper and lower arms.

9. The neck traction device of claim 1, further comprising an elongate member that extends at least part of the way along the user's thoracic vertebrae, when in use.

10. The neck traction device of claim 1, further comprising a locking mechanism adapted to lock the device in a folded state.

11. The neck traction device of claim 1, further comprising a filled support.

12. The neck traction device of claim 1, wherein the filled support is a pillow.

* * * * *